United States Patent [19]

Tokuno et al.

[11] Patent Number: 4,592,278

[45] Date of Patent: Jun. 3, 1986

[54] PRINTING APPARATUS

[75] Inventors: Masateru Tokuno, Nishinomiya; Tetsuya Sawada, Kyoto; Yasuharu Mori, Amagasaki, all of Japan

[73] Assignee: Rengo Co., Ltd., Osaka, Japan

[21] Appl. No.: 680,294

[22] Filed: Dec. 10, 1984

[30] Foreign Application Priority Data

Dec. 9, 1983 [JP] Japan ..... 58-233292

[51] Int. Cl.[4] ..... B41F 5/04; B41F 13/02

[52] U.S. Cl. ..... 101/181; 101/228

[58] Field of Search ..... 101/228, 219, 181, 227, 101/178, 225, 224, 231, 180, 138, 139, 143; 226/24, 29, 30, 31, 32, 33, 42, 2

[56] References Cited

U.S. PATENT DOCUMENTS

| | | | |
|---|---|---|---|
| 1,653,199 | 12/1927 | Belcher | 101/228 |
| 1,978,073 | 10/1934 | Belcher | 101/228 |
| 1,978,715 | 10/1934 | Meisel | 101/228 |
| 2,758,541 | 8/1956 | Tison | 101/228 |
| 3,049,078 | 8/1962 | Smith, Jr. | 101/228 |
| 3,426,680 | 2/1969 | Kaufmann | 101/228 X |

*Primary Examiner*—J. Reed Fisher

*Attorney, Agent, or Firm*—Wenderoth, Lind & Ponack

[57] ABSTRACT

An improved printing apparatus has printing units, a pair of feed rolls, a pair of pull rolls, a speed adjusting unit having a pair of rolls, and a control unit. The speed adjusting unit reciprocates linearly to advance and retreat the web in the printing units. While the web is being printed, the feed and pull rolls are stopped. While it is not being printed, they are driven to feed the web for a distance equal to one printing length. The speed adjusting unit is driven so as to move at a speed equal to half the peripheral speed of the plate cylinder while the web is being printed.

3 Claims, 7 Drawing Figures

PRIOR ART FIG.1
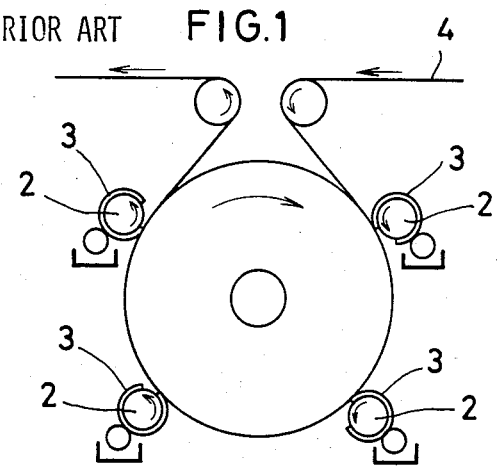
FIG. 3
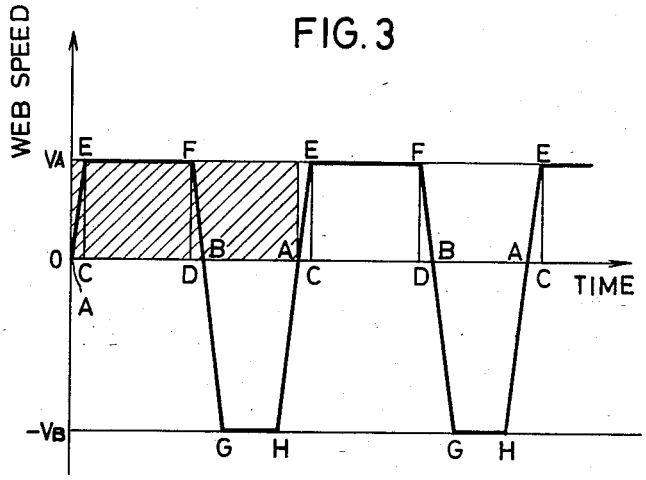
FIG. 4
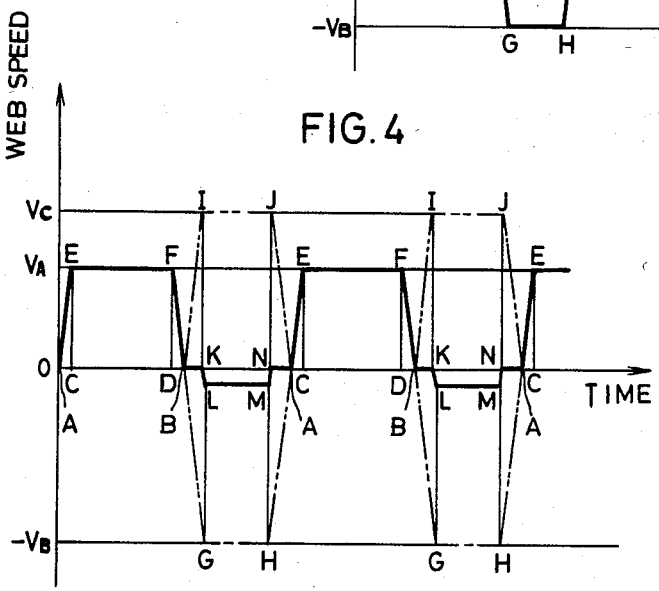

PRINTING APPARATUS

BACKGROUND OF THE INVENTION

The present invention relates to improvements in a printing apparatus for printing a running web.

FIG. 1 shows a conventional color printing apparatus in which as the web 4 to be printed passes between an impression cylinder 1 and plate cylinders 2, it is printed by plates 3 mounted on the plate cylinders. The impression cylinder and the plate cylinders are driven from a single motor through a geared transmission for synchronized printing. Since the circumference of the plate cylinders is determined by the printing length which is the length of the plate, each time the printing length changes, new plate cylinders having a circumference corresponding to the new printing length become necessary. This increases the printing cost. Further, each time the printing length changes, heavy plate cylinders have to be removed and replaced with new ones. New plate cylinders with new plates mounted thereon have to be mounted on the impression cylinder with a suitable contact pressure. This was very troublesome work. Further, fine adjustments of the transmission were necessary for phase tuning between the plate cylinders for accurate register. Another disadvantage is that a lot of plate cylinders have to be maintained.

SUMMARY OF THE INVENTION

An object of the present invention is to provide an improved printing apparatus which obviates the necessity of preparing different plate cylinders for different printing lengths.

BRIEF DESCRIPTION OF THE DRAWINGS

Other objects and features of the present invention will become apparent from the following description taken with reference to the accompanying drawings, in which:

FIG. 1 is a schematic view of a prior art color printing machine;

FIG. 3 is a graph showing how the speed of web would change if it were controlled by only the speed adjusting unit;

FIG. 4 is a graph showing how the speed of web is actually controlled;

DESCRIPTION OF THE PREFERRED EMBODIMENT

Figure 2:
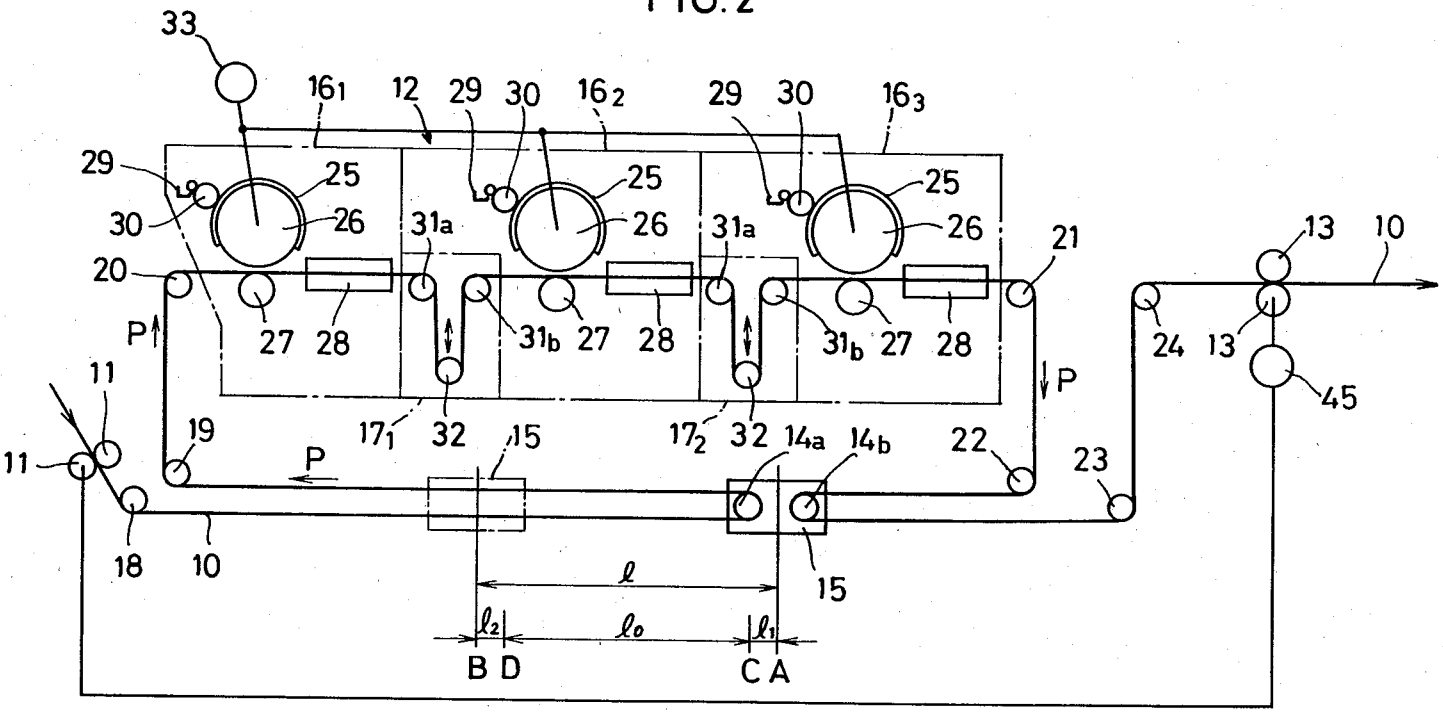
FIG. 2 is a schematic view of an embodiment of the present invention.

Referring to FIG. 2, a web 10 is fed by a pair of feed rolls 11 to a printing apparatus 12 and taken out of it by a pair of pull rolls 13. The printing apparatus 12 comprises a speed adjusting unit 15 having a pair of rolls 14*a*, 14*b* to adjust the speed of the web 10 in the printing apparatus 12, a plurality of printing units $16_1$, $16_2$ and $16_3$ for printing the web 10 with different colors, and web length adjusting units $17_1$ and $17_2$ provided between the adjacent printing units to adjust the length of the web existing between the adjacent printing units to the printing length multiplied by an integer.

The web 10 passes around a first guide roll 18, the roll 14*a* of the speed adjusting unit 15, a second guide roll 19 and a third guide roll 20 and arrives at the first printing unit $16_1$. After passing through the web length adjusting unit $17_1$, second printing unit $16_2$, web length adjusting unit $17_2$ and third printing unit $16_3$, the web passes around a fourth guide roll 21, a fifth guide roll 22, the roll 14*b* of the speed adjusting unit 15, a sixth guide roll 23 and a seventh guide roll 24, and is discharged by the pull rolls 13 to the next station.

The web runs from the first guide roll 18 to the roll 14*a* in the same direction (rightward in FIG. 2) as from the roll 14*b* to the sixth guide roll 23, and in a direction reverse to the direction (leftward in FIG. 2) in which the web runs from the roll 14*a* to the second guide roll 19 and from the fifth guide roll 22 to the roll 14*b*. The speed adjusting unit 15 having the rolls 14*a*, 14*b* is adapted to be reciprocatable for a predetermined distance l in parallel with the direction in which the web runs.

The printing units $16_1$, $16_2$ and $16_3$ each have a plate cylinder 26 having a longer circumference than the maximum printing length and adapted to carry a plate 25, an impression cylinder 27 adapted to press the web 10 against the plate 25 on the plate cylinder 26, a dryer 28 provided downstream of the plate cylinder 26 for drying the ink applied to the web by the plate 25, and an ink roll 30 for applying ink in an ink reservoir 29. After having been printed by the plates 25 in the printing units $16_1$, $16_2$ and $16_3$ and dried by the dryers 28, the web 10 is discharged.

The web length adjusting units $17_1$, $17_2$ each have an adjuster roll 32 provided between paper rolls 31*a* and 31*b* so as to be vertically movable. By adjusting the vertical position of the adjuster roll 32, the length of the web existing between the adjacent printing units is adjusted to the printing length multiplied by an integer.

The plate cylinders 26 in all the printing units 16 are coupled to a first motor 33 through a transmission (not shown) having gears, sprockets, chain, etc. for synchronous driving. The feed rolls 11 and the pull rolls 13 are driven from a motor 45.

The speed adjusting unit 15 is driven by a control motor through a transmission for converting a rotational motion to a linear motion so as to go and come back while the plate cylinder 26 makes one full turn, as will be described later in more detail. Now, let us assume that the feed rolls 11 and the pull rolls 13 are stopped nipping the web therebetween while the first motor 33 for the plate cylinders 26 remain running. On the other hand, the speed adjusting unit 15 is driven so as to reciprocate between a point A and a point B. Thus, while the speed adjusting unit 15 moves from the point A to the point B, the web in the printing units $16_1$–$16_3$ is moved forward for a distance equal to 2l in the direction of arrow P. While the unit 15 moves from the point B back to the point A, the web is moved backward for a distance equal to 2l in a direction reverse to the direction of arrow P. This results that the web would be printed overlapped on the same positions by the plate 25 in each of the printing units $16_1$–$16_3$.

Thus, if the web is supplied by the feed rolls 11 to the printing apparatus 12 and discharged by the pull rolls 13 for a distance equal to the printing length L while the speed adjusting unit 15 is moving from the point B back to the point A, the web 10 can be printed continuously not overlapped in any printing unit. This is the basic concept of the present invention.

For this purpose, the speed adjusting unit 15 may be controlled so that while it is moving from the point A to the point B, the speed of the web existing between the roll 14*a* and the roll 14*b* will be equal to the peripheral speed of the plate cylinder 26 (which is, strictly speaking, the peripheral speed of the plate 25. But, it will be referred to as the peripheral speed of the plate cylinder for simplicity). Namely, the speed of the speed adjusting unit 15 may be controlled to be half the peripheral speed of the plate cylinder 26. Thus, the unit 15 is accelerated to such a speed, kept at the speed and decelerated until it stops at the point B. While the unit 15 is moving from the point B to the point A, it should be controlled to be driven at a sufficiently high speed to prevent the web from breaking.

At or before the point C corresponding to the start of printing with the plate 25, the speed of the web 10 existing between the roll 14*a* and roll 14*b*, which is double the speed of the speed adjusting unit 15, must become equal to the peripheral speed of the plate cylinder 26. At or after the point D corresponding to the end of printing, the speed of the web becomes lower than the peripheral speed of the plate cylinder 26. The distance lo between the print start point C and the print end point D is equal to half the maximum printing length or longer than that. The maximum printing length is determined by the circumference Lo of the plate cylinder 26.

The foregoing will be described in more detail with reference to FIGS. 3 and 4. Referring firstly to FIG. 3, the thick line shows how the speed of the web 10 changes if the speed adjusting unit 15 is reciprocated with the feed rolls 11 and the pull rolls 13 stopped nipping the web so that there will be no web supply to the feed rolls 11 or no web discharge from the pull rolls 13. On FIG. 3, the web speed is zero at the point A, and is accelerated forwardly so that it will become equal to the peripheral speed $V_A$ of the plate cylinder 26 at the print start point C at latest. The web speed is kept at $V_A$ to the print end point D, from which the web speed is decelerated until it becomes zero at the point B. The web speed is then accelerated backwardly to a speed $(-V_B)$ (which should have a larger absolute value than the peripheral speed $V_A$ of the plate cylinder 26), maintains the speed $(-V_B)$ for some time, and is decelerated until it becomes equal to zero at the point A. This completes one cycle. Thereafter, this cycle is repeated. During this one cycle, the plate cylinder 26 makes a full turn, covering a distance represented by the area of the shadowed rectangle portion in FIG. 3.

The web speed is controlled by the speed adjusting unit 15 so that the web will move backwardly for the same distance during the period from the point B back to the point A as the distance for which the web moves forwardly from the time point A to the time point B. The distance covered from the point A to B corresponds to the area of a trapezoid ABFE and the distance covered from the point B and A corresponds to the area of a trapezoid BGHA. One printing length L is represented by the area of a rectangle CDFE. The backward movement of the speed adjusting unit 15 is done while the web 10 is not being printed because the plate 25 is not in contact with the web.

Because the web is moved forward and backward for the same distance, as described above, if the feed rolls and the pull rolls were stopped throughout during the printing, the web would be printed overlapped. However, actually, as shown in FIG. 4, while the speed adjusting unit 15 moves from the point B back to the point A, the web is fed by the feed rolls 11 by a length equal to one printing length and is pulled out by the pull rolls 13. In other words, when the unit 15 arrives at the point B, the feed rolls 11 and the pull rolls 13 start to be driven. They are accelerated to speed $V_C$, maintain that speed for some time and are decelerated to zero speed. These rolls are controlled so that a length of the web equal to one printing length L will be fed and discharged, namely so that the area of a trapezoid BIJA will be equal to L. On the other hand, the web is affected by the speed adjusting unit 15, too, from the point B back to the point A, as shown in FIG. 3 with a thick line BGHA.

Thus, the actual speed of the web in the printing units from point B to point A will be as shown in FIG. 4 with a thick line BKLMNA as a result of combination of the speed shown with a line --- BIJA with the speed shown with a line --- BGHA.

The web is printed from point C to point D and is fed not printed from point A to point C and from point D to point B. The distance for which the web runs not printed is represented by the area of a triangle ACE plus the area of a triangle DBF. The above-mentioned control is such that the distance covered not printed will be offsetted by the distance backwardly travelled during the time from point B back to point A, which is represented by the area of a trapezoid KLMN.

While the web is being printed, the speed of web in the printing units is controlled to be equal to the peripheral speed $V_A$ of the plate cylinders 26, and while the speed adjusting unit is moving from point B back to point A, the web is supplied for a length equal to one printing length L. This results that the web is printed continuously in any printing unit.

In polychrome printing, since the web length adjusting units $17_1$, $17_2$ are provided to adjust the length of web existing between the adjacent printing units to the printing length multiplied by an integer, the web is polychrome printed in the printing units $16_1$, $16_2$ and $16_3$ with accurate registration.

Although on the graph of FIG. 4 the gradients of acceleration and deceleration from point B to I and from point J to A are equal to the gradients from point B to G and from point H to A, this is not essential. Namely, the speed of the feed rolls 11 and the pull rolls 13 may be freely selected so long as the web is supplied just for a length equal to one printing length L while the unit is moving from point B back to point A.

Although in the preferred embodiment the supply and discharge of web are controlled to start just at the point B and end just at the point A, this does not mean any limitation. It may be started and stopped at any time during the period from the print end point D to the next print start point C so long as the web is supplied for a length equal to one printing length during that period.

Figure 5:
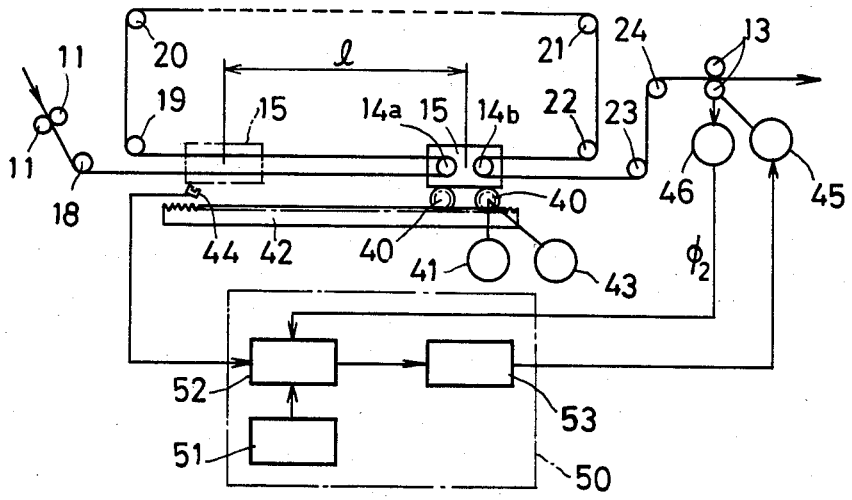
FIG. 5 is a block diagram of a circuit for controlling the feed rolls and the pull rolls.

Next, with reference to FIG. 5, it will be described how the feed rolls 11 and the pull rolls 13 are controlled to feed the web for a distance equal to one printing length L during one cycle of operation.

Pinions 40 in the speed adjusting unit 15 are driven by a second motor 41 such as a servomotor so as to reciprocate on and along a rack 42. As they move, a first pulse generator 43 produces a pulse signal $\phi_1$ proportional to the distance covered. A position detector 44 is provided adjacent to the speed adjusting unit 15 to detect the arrival of the unit 15 at the point B and give a signal.

The third motor 45 for driving the feed rolls and the pull rolls is controlled by a signal from a roll control circuit 50 for controlling the supply and discharge of the web. A second pulse generator 46 produces a pulse signal $\phi_2$ proportional to the number of revolutions of the feed rolls and the pull rolls which are synchronously driven by the third motor 45 through a transmission (not shown) such as gears, sprockets, chains, etc. The second pulse generator 46 may be mounted on the roll 11 or 13 or on other part coupled to them.

In the roll control circuit 50, the printing length L is set on a first setter 51. In response to a detection signal from the position detector 44, a first arithmetic sequence unit 52 reads the preset value L, counts the pulse signal $\phi_2$ from the second pulse generator 46, and gives a motor signal to the third motor 45 through a driving unit 53 to control it. This motor signal obtained by computation is such that the third motor 45 and thus the feed rolls 11 and the pull rolls 13 will be driven to feed the web, as shown in FIG. 4 with a line , for a length equal to one printing length L while the web is not being printed.

The position detector 44 may be omitted. Instead the rolls 11 and 13 may be controlled to start in response to a print end signal.

Figure 6:
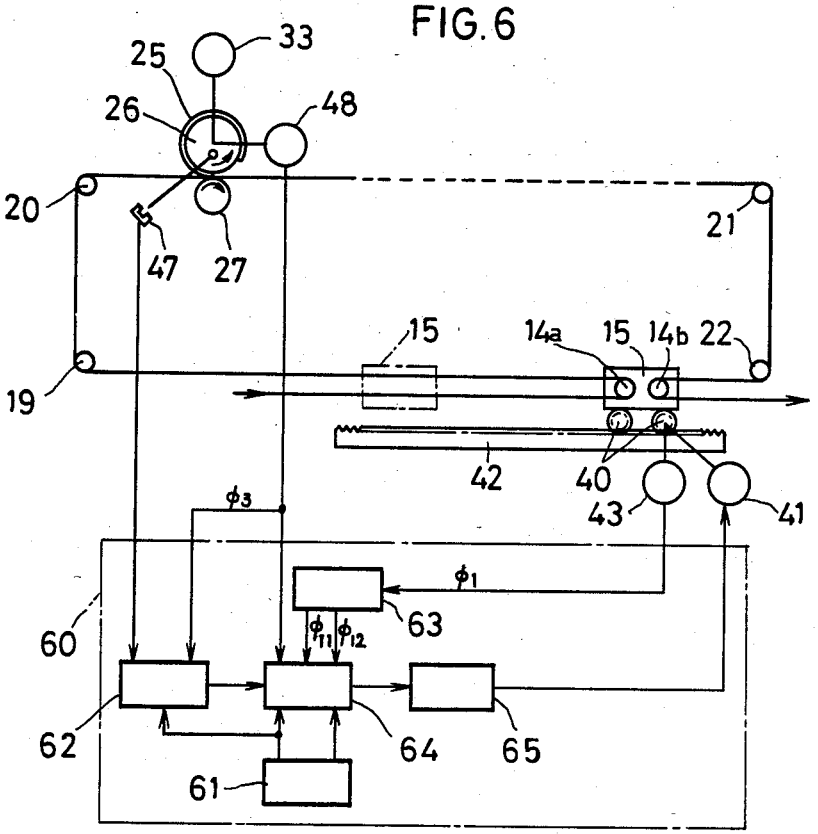
FIG. 6 is a block diagram of a circuit for controlling the speed adjusting unit.

Next, with reference to FIG. 6, a speed control circuit 60 for the second motor 41 for driving the speed adjusting unit 15 will be described.

A print start detector 47 is provided near the plate cylinder 26 to detect the print start point (point C in FIGS. 3 and 4) and give a signal. A third pulse generator 48 produces a pulse signal $\phi_3$ proportional to the number of revolutions of the plate cylinder 26. On a second setter 61, the printing length L and the circumference Lo of the plate cylinder are set. In response to the print start signal from the detector 47, a preset counter 62 reads the printing length L and starts to count the pulse signal from the third pulse generator 48. When its count becomes equal to the printing length L, the preset counter 62 will give a print end signal to show that the printing with the plate 25 is complete. A pulse discriminator 63 judges whether the first pulse generator 43 is turning forwardly or reversely (that is, whether the web is moving forwardly or reversely) and gives a positive or negative pulse signal.

A second arithmetic sequence unit 64 receives the values L and Lo preset on the setter 61, the print end signal from the preset counter 62, the pulse signal $\phi_3$ from the third pulse generator 48, and the positive pulse signal $\phi_{11}$ or negative pulse signal $\phi_{12}$ from the pulse discriminator 63, and gives a motor signal to the second motor 41 through a driving unit 65. This motor signal is such that the speed adjusting unit 15 will be driven so that the web will be fed at such a speed as shown in FIG. 3.

The second motor 41 is controlled so that the area of a trapezoid BGHA minus the area of a triangle DBF minus the area of a triangle ACE will be $-L$ ($=-2lo$). The area of a rectangle CCEE will be equal to the circumference of the plate cylinder 26. This means that during the time from the print start to the next print start, the plate cylinder makes one full turn.

Next, with reference to FIG. 7, a mechanism 70 will be described through which the speed adjusting unit 15 is driven from the first motor 33 for driving the plate cylinder. The unit 15 is guided so as to reciprocate linearly on guide rails 71*a*, 71*b*. A pin 72 on the speed adjusting unit 15 is fitted in a slit 74*a* formed in a crank 74 which has one end pivotally supported on a shaft 73. The crank 74 has at its middle portion a shaft 75 on which one end of an arm 76 is pivotally supported. Its other end is pivotally mounted on a shaft 78 which is provided at one end of an arm 77. Its other end is fixedly mounted on a fixed but turnable shaft 78' on which an arm 80 having a pin 79 at its other end is secured. The pin 79 is engaged in a cam groove 82 formed in a cam plate 81 which is rotated in the direction of arrow q through a driving shaft 83 driven from the first motor 33 for the plate cylinder.

Figure 7:
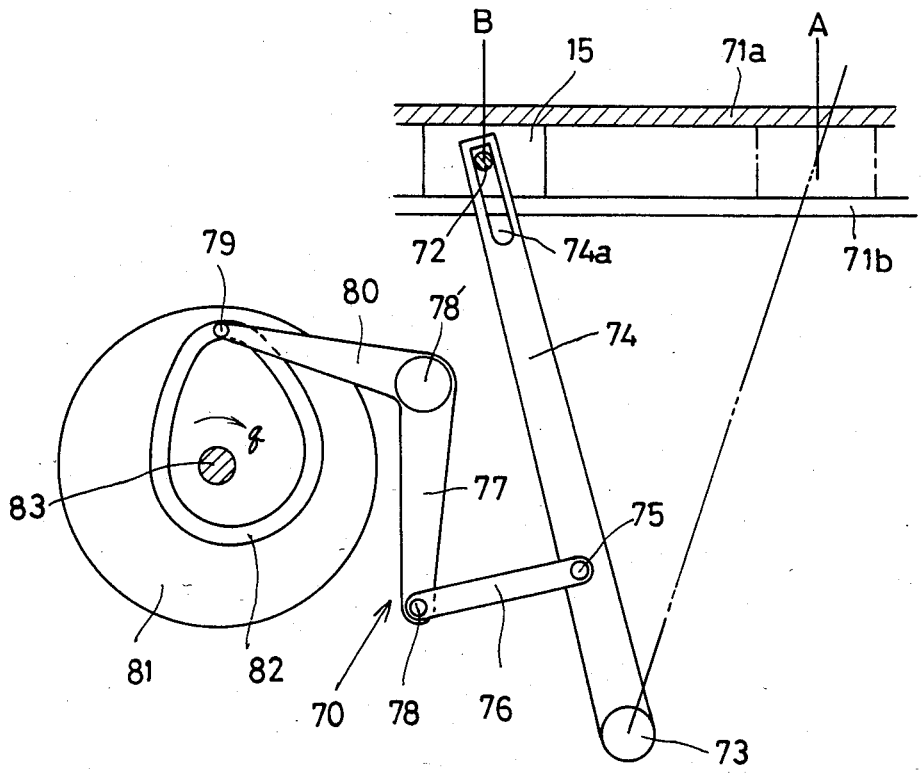
FIG. 7 is a view showing an example of the control mechanism for the speed adjusting unit.

As the cam plate 81 makes a full turn from the state of FIG. 7 in the direction of arrow q, the pin 79 will go down and up and the crank 74 sway around the shaft 73. As the crank sways, the speed adjusting unit 15 moves from the point B to the point A and then back to the point B. The speed adjusting unit 15 can be adjusted to run at a speed equal to half of the peripheral speed of the plate cylinder 26 during the time from the print start point C to the print end point D, by properly selecting the lengths of the crank 74 and arms 76, 77 and 80, the shape of the cam groove 82, etc. The speed adjusting unit may be driven by means of any other mechanism.

Although the preferred embodiment has three printing units because it is designed for polychrome printing, one printing unit will suffice for monochrome printing, of course. In this case, no web length adjusting unit is needed. Although in the preferred embodiment three printing units are used, this does not mean any limitation.

Although in the embodiment the web speed becomes equal to the peripheral speed of the plate cylinder at the print start point and is decelerated at the print end point, it may become equal to that before the print start point and be decelerated some time after the print end point.

The abovesaid printing length may not be a single printing length in a continuous printing with no blank between the adjacent printed portions, but include any allowance for subsequent cutting, glueing or other processing as well as the actually printed portion.

What are claimed are:

1. A printing apparatus for printing a running web, comprising:

at least one printing unit having a plate cylinder having a circumference which is greater than the maximum printing length and adapted to carry a plate, and an impression cylinder adapted to press the web against said plate on said plate cylinder, and an ink roll;

a first motor for driving said plate cylinder;

a pair of feed rolls for feeding the web to said printing unit;

a pair of pull rolls for discharging the web out of said printing unit;

a speed adjusting means having a pair of rolls and adapted to be reciprocatable on a straight line for a predetermined distance, the web being guided so as to run between said feed rolls, and around one of said pair of rolls, and through said printing unit, and around the other of said pair of rolls, and between said pull rolls;

a second motor for driving said speed adjusting means;

a third motor for driving said feed rolls and said pull rolls;

a first electrical control means for controlling the speed of said second motor in relation to the speed of said first motor so that said speed adjusting means will be driven so as to move at a speed equal to half the peripheral speed of said plate cylinder while the web is being printed, and so as to go and come back for said predetermined distance while said plate cylinder makes a full turn; and a second electrical control means for controlling the speed of said third motor in relation to the speed of said second motor so that said feed rolls and said pull rolls will be driven so as to stop while the web is being printed, and so as to feed and discharge the web to and from said printing unit for a length equal to one printing length while the web is not being printed.

2. A printing apparatus as claimed in claim 1, wherein said first electrical control means receives a signal proportional to the printing length, and a signal proportional to the circumference of the plate cylinder, and a print start signal, and pulse signals proportional to the number of revolutions of said first and second motors, and then performs a predetermined computation and controls said second motor in accordance with the result of the computation.

3. A printing apparatus as claimed in claim 1, wherein said second electrical control means receives a signal proportional to the printing length, and a signal indicating the position of said speed adjusting means, and a pulse signal proportional to the number of revolutions of said third motor, and then performs a predetermined computation and controls said third motor in accordance with the result of the computation.

* * * * *